US011666788B2

(12) United States Patent
Johnson

(10) Patent No.: US 11,666,788 B2
(45) Date of Patent: Jun. 6, 2023

(54) WIDE-AREA FIRE-RETARDANT SYSTEM USING DISTRIBUTED DENSE WATER FOGGER

(71) Applicant: Jeff Johnson, San Francisco, CA (US)

(72) Inventor: Jeff Johnson, San Francisco, CA (US)

( * ) Notice: Subject to any disclaimer, the term of this patent is extended or adjusted under 35 U.S.C. 154(b) by 60 days.

(21) Appl. No.: 17/013,653

(22) Filed: Sep. 7, 2020

(65) Prior Publication Data

US 2021/0308507 A1 Oct. 7, 2021

Related U.S. Application Data

(63) Continuation of application No. 16/895,635, filed on Jun. 8, 2020.

(60) Provisional application No. 63/006,041, filed on Apr. 6, 2020.

(51) Int. Cl.

| | |
|---|---|
| ***A62C 37/36*** | (2006.01) |
| ***A62C 3/02*** | (2006.01) |
| ***A62C 35/64*** | (2006.01) |

(52) U.S. Cl.

CPC ..... *A62C 3/0271* (2013.01); *A62C 3/0257* (2013.01); *A62C 35/64* (2013.01); *A62C 37/36* (2013.01)

(58) Field of Classification Search

CPC ..... A62C 3/02; A62C 3/0271; A62C 3/0257; A62C 3/0292; A62C 3/0214; A62C 35/64; A62C 37/36; A62C 37/04

See application file for complete search history.

(56) References Cited

U.S. PATENT DOCUMENTS

| | | | | |
|---|---|---|---|---|
| 5,083,618 | A | 1/1992 | Hayes | |
| 5,165,482 | A | 11/1992 | Smagac et al. | |
| 5,263,543 | A | 11/1993 | Nigro | |
| 5,323,861 | A | 6/1994 | Kaidonis et al. | |
| 5,507,350 | A * | 4/1996 | Primlani | A62C 3/025 169/36 |
| 5,692,571 | A | 12/1997 | Jackson | |
| 5,732,511 | A | 3/1998 | Scott | |

(Continued)

FOREIGN PATENT DOCUMENTS

FR 2672222 A1 8/1992

OTHER PUBLICATIONS

Mist fountains at Hungarian Parliament Building, published on TripAdvisor, https://www.tripadvisor.com/LocationPhotoDirectLink-g274887-d276817-i199638223-Parliament-Budapest_Central_Hungary.html, Jun. 2016.

(Continued)

*Primary Examiner* — Christopher R Dandridge
(74) *Attorney, Agent, or Firm* — Steven J Shattil

(57) ABSTRACT

A wide-area wildfire suppression system uses a network of geographically distributed water sprayers, and includes at least one wind sensor and a fire-suppression controller communicatively coupled to the water sprayers and the at least one wind sensor. The at least one wind sensor detects wind direction and communicates wind-direction information to the fire-suppression controller, which uses the wind-direction information to activate at least one of the water sprayers upwind of an asset or area to be protected. Parameters of the water spray, such as flow rate, droplet size, spray pattern, spray direction, spray elevation, or aeration, can be adapted based on wind direction or wind speed.

20 Claims, 3 Drawing Sheets

(56) References Cited

U.S. PATENT DOCUMENTS

| | | | | |
|---|---|---|---|---|
| 5,931,233 | A | 8/1999 | La Bonte et al. | |
| 6,109,361 | A | 8/2000 | Henderson | |
| 6,167,971 | B1 | 1/2001 | Van Lingen | |
| 6,360,968 | B1 | 3/2002 | Orrange et al. | |
| 6,679,337 | B1 | 1/2004 | Perry et al. | |
| 6,772,562 | B1 | 8/2004 | Dadamo | |
| 7,090,028 | B2 | 8/2006 | Adiga et al. | |
| 7,478,680 | B2 | 1/2009 | Sridharan et al. | |
| 8,291,990 | B1 | 10/2012 | Mohr | |
| 2004/0055765 | A1 | 3/2004 | Dillman | |
| 2005/0072851 | A1 | 4/2005 | Weatherspoon | |
| 2008/0000649 | A1 | 1/2008 | Guirguis et al. | |
| 2009/0192654 | A1* | 7/2009 | Wendte | A01M 7/0057 47/58.1 SC |
| 2009/0266565 | A1 | 10/2009 | Char et al. | |
| 2010/0070097 | A1* | 3/2010 | Morgenstern | A62C 35/64 700/283 |
| 2010/0071917 | A1* | 3/2010 | Lalouz | A62C 3/0214 169/60 |
| 2012/0168185 | A1* | 7/2012 | Yount | A62C 3/0271 169/16 |
| 2015/0306618 | A1 | 10/2015 | Petter et al. | |
| 2020/0155881 | A1 | 5/2020 | Tohidi et al. | |
| 2021/0398309 | A1 | 12/2021 | Rossi Tison et al. | |

OTHER PUBLICATIONS

ColdMist product catalog, https://pdf.directindustry.com/pdf/coldmist-cooling-australia/automated-evaporation-systems-smarth2o/117447-610119.html#open.

Bete, "Spray Nozzles, Fabriations, & Systems for Industrial Applications"; https://www.bete.com/PDFs/BETE_1218USA_Catalog.pdf, 2019.

Lizzie Johnson, Peter Fimrite, and Sarah Ravani, "Wildfire forces thousands to evacuate in Lake County", San Francisco Chronicle, Jun. 25, 2018, https://www.sfgate.com/bayarea/article/Wildfire-forces-hundred-to-evacuate-in-Lake-County-13021485.php.

ColdMist, 420F Evaporator product sheet, https://pdf.directindustry.com/pdf/coldmist-cooling-australia/420b-evaporator/117447-610116.html.

ColdMist, Mega PoleCat Evaporator product sheet, https://pdf.directindustry.com/pdf/coldmist-cooling-australia/mega-polecat-evaporator/117447-610118.html.

* cited by examiner

WIDE-AREA FIRE-RETARDANT SYSTEM USING DISTRIBUTED DENSE WATER FOGGER

CROSS REFERENCE TO PRIOR APPLICATIONS

This application is a continuation of U.S. patent application Ser. No. 16/895,635, filed on Jun. 8, 2020, which claims the priority benefit of U.S. Patent Provisional Application Ser. No. 63/006,041, filed on Apr. 6, 2020, both of which are expressly incorporated by reference in its entirety.

BACKGROUND

I. Field

The following relates to methods, systems, and devices for fighting wildfires and protecting assets from wildfires, and more particularly, to provisioning and operating a geographically distributed network of sprayers.

II. Background

The background description includes information that may be useful in understanding the present inventive subject matter. It is not an admission that any of the information provided herein is prior art or relevant to the presently claimed inventive subject matter, or that any publication, specifically or implicitly referenced, is prior art.

Combustion, commonly known as burning, is a chemical reaction that occurs when the temperature of a material reaches a temperature where it begins to react rapidly with oxygen. That temperature is called the ignition point. The combustion reaction is exothermic, meaning it releases more energy than it consumes. Most of the extra energy is released in the form of heat, which heats up surrounding material, possibly igniting that material. A positive feedback loop develops, in which combustion at one site heats up neighboring material to its ignition point, spreading the combustion.

Wood and paper ignite at 451 degrees F. (233 degrees C.), while other materials combust at lower or higher temperatures. For example, white phosphorus ignites in air at about 86 degrees F. (30 degrees C.), oil and gasoline ignite at 495 degrees F. (232 degrees C.), acrylic plastic ignites at 560 degrees F. (293 degrees C.), and steel ignites at 1500 degrees F. (816 degrees C.).

Flames are not the cause of combustion, they are a result. Flames consist of hot gases—emitted by the burning material or in the surrounding air—expanding away from the point of combustion, carrying tiny particles of still-combusting material with them. The particles glow while they are combusting, but as they are carried by the hot gases away from the source of combustion and exhaust their own combustible material, their temperature drops until they stop glowing. The point where the particles stop glowing (i.e., emitting light) is perceived by people as the boundary of the flame, however, the surrounding gas beyond the visible flame is still hot. A heat-sensitive view (e.g., infra-red camera) would see the "flame" area as larger, with a less clear boundary.

The hot gases and combusting particles in flames—and even beyond the visible boundary of the flames—heat up surrounding materials they meet. If those surrounding materials reach their ignition temperature and oxygen is present, they, in turn, ignite.

Not all combustion produces flames. For example, underground peat, coal veins, or tree roots can burn for days or even years without producing any flames. Combustion requires the presence of oxygen. If oxygen levels at the point of combustion are reduced enough, combustion will slow and possibly stop.

A simple way to reduce the oxygen available to a fire is to cover the fire with something separating it from the surrounding air. Thus, one can put out a small fire—e.g., a burning match or cigarette—by stepping on it. Similarly, small fires can sometimes be extinguished by covering them with a blanket—as long as the blanket isn't very porous and doesn't itself have a low ignition temperature. Many fire extinguishers work by covering fires with non-flammable foam, blocking the fire's access to oxygen.

For centuries, people have fought fires by throwing water onto them. Water is effective for extinguishing combustion in some materials, but not in all. When water is thrown onto a wood or paper fire, it heats up and evaporates, thereby taking heat away from the combustion site, thus lowering the combustion site's temperature. If the temperature drops below the material's ignition temperature, the combustion stops spreading. Water covering burning material also briefly shields the burning material from contact with air, thereby blocking the necessary access to oxygen.

Water is not effective for extinguishing all fires. Gasoline, oil, and alcohol are lighter than water. Throwing liquid water onto them doesn't help much, because the water immediately sinks below the fuel, where it does not serve any purpose. Throwing water onto certain burning materials can even be counterproductive. If the material that is burning is magnesium, throwing water onto it can cause the hot magnesium to react with the water, releasing hydrogen gas, which has a low ignition temperature and so will ignite, making the fire worse.

To improve coverage, many fire hoses spray water in the form of small droplets, more like a sprinkler than a garden hose. However, spraying water as small droplets limits the distance that the water can shoot from the hose, due to low inertia and air resistance. Water shot out of a wide hose in a thick stream driven by high pressure has more inertia and is affected less by air resistance, so it can travel farther from the end of the hose, but much of that water simply runs off and contributes little to extinguishing the fire.

Just as blowing on a campfire with one's mouth or an air bellows can cause the fire to grow, high winds can increase the flow of oxygen over combustion sites. This increases the burning rate and therefore the temperature of the surrounding air and other materials.

Wind can also spread hot gases and burning materials into areas where there is more combustible material, causing the fire to advance in the direction of the wind faster than it otherwise would. High winds have been observed to throw glowing embers a mile or more ahead of the main front of an advancing fire, greatly increasing the speed at which the fire spreads and igniting separate fires in areas that the main fire has not yet reached.

The United States averaged 58,000 wildfires per year from 2006 to 2016 [source: National Interagency Fire Center, https://www.nifc.gov/fireInfo/nfn.htm]. In October 2017, several wind-driven wildfires burned through housing developments, wineries, and towns in Northern California [source: SF Chronicle, October 9 and later]. Firefighters responded but were overwhelmed; they could not stop the fast-spreading fires from killing dozens of people, destroying thousands of homes and other buildings, and burning tens of thousands of acres of land.

Many of the residences and other properties that were burned in the 2017 N. California fires were in areas known to be at risk of wildfires [SF Chronicle, October 27, http://www.sfchronicle.com/news/article/Sonoma-County-hazard-plan-foresaw-deadly-Wine-12310097.php]. In 1967, a similar wildfire—dubbed the Hanley fire—had burned much of the same areas burned by 2017's Tubbs fire. Similar devastating wildfires occurred in California in 2018, including one in Paradise Calif. that killed 85 people and destroyed 13,000 homes and 5,000 other structures.

As of Dec. 22, 2019, over 6,876 fires have been recorded according to Cal Fire and the US Forest Service, totaling an estimated of 253,214 acres (102,472 hectares) of burned land. In late October, the Kincade Fire became the largest fire of 2019, burning 77,758 acres in Sonoma County by November 6 [Wikipedia: 2019 California Wildfires].

Also in late 2019, drought conditions combined with high temperatures and high winds in Southeast Australia sparked wildfires that burned many large areas of countryside and some residential communities. As climate change increases average temperatures worldwide, some areas, such as northern California and southeastern Australia, are becoming giant tinderboxes, at risk of increasingly frequent wildfires. As long as people continue to live and work in such areas, some form of protection against wildfires will be needed.

In the developed neighborhoods ravaged by the recent N. California fires, the main fire-prevention methods and infrastructure were those seen all over the U.S.: scattered firestations and one or two fire hydrants per block. That infrastructure is designed to fight housefires, i.e., fires that start in a home or business and burn mainly that property and possibly adjacent ones. In a few documented cases, firefighters and residents have saved specific properties from destruction by spraying water on and around them. But when a wildfire is driven by high winds into a residential area, such as the Tubbs fire that blew into the town of Santa Rosa from its origin miles away, or the Camp fire that started in rural back-country and travelled for several hours before it nearly wiped out the town of Paradise, firefighters are mostly helpless to do anything other than helping residents escape.

For fighting fires in uninhabited forested or grassy areas, there is usually little or no infrastructure. Some such areas have pre-built fire-break roads, water storage tanks, and permanently-stationed fire watchers. However, most of the equipment and personnel used to fight forest fires is brought in at the time of the fire: airplanes and helicopters to drop water and fire-retardants, bulldozers to clear fuel and create impromptu fire-breaks, fire trucks to spray water and retardants, and of course, firefighters to operate the equipment and decide on courses of action. This may be the best way to fight fires in uninhabited countryside, but when wildfires approach residential or business areas, it is unsuitable. For example, it would be unacceptable to bulldoze a street of unburned homes to create a fire-break to slow the progress of an approaching fire. Similarly, most people consider spraying fire-retardant into housing developments to be undesirable (see: Scauzillo, "Is that red fire retardant dropped from planes during wildfires safe for humans and the environment?"). In short, history—especially recent history in California and Australia—shows that methods and infrastructure for fighting local structure fires is insufficient for fighting large, fast-moving wildfires in residential areas. Similarly, methods and equipment for fighting forest fires in uninhabited areas is inadequate for fighting wildfires that move into populated areas.

Every drop of water thrown onto a fire that doesn't contribute to reducing the burning material's temperature, or preventing surrounding combustible material from reaching its ignition temperature, or separating combustion sites from oxygen, is wasted. Currently, much of the water thrown onto a fire runs off down sewer drains and across streets, floors, and the ground, or it soaks into the ground. Thus, much of the water thrown onto fires is wasted. This wasted water greatly increases the total amount of water (and water pressure) required for fighting fires.

SUMMARY

In an exemplary, but non-limiting, application of some aspects disclosed herein, homes, businesses, neighborhoods, or towns in areas that are at risk of wildfires can be protected by a wildfire-prevention infrastructure that comprises water sources, pipes, and high-pressure cold water mist generators. The mist generators could be placed around or outside a protection area's perimeter, along the likely approach path of a wildfire, and/or throughout the area, including around and on buildings. In some aspects, this distributed infrastructure need not entirely surround the protected area, because the likely direction of approach of wildfires is often known based on expected wind directions and the location of combustible material. The mist generators could be activated remotely, or triggered automatically when an approaching fire reaches detectors located around a protected area.

Once activated, mist generators can create a dense fog of extremely fine water droplets, blanketing an area, its perimeter, and/or a wildfire's approach-route to the area. The water droplets can be small enough to remain suspended in the air for minutes or even hours. In calm conditions, this can result in a dense, thick protective cold mist barrier around a protected area that fire would have difficulty breaching. In the windy conditions typical of the fastest moving, most damaging wildfires, the wind comes from a specific, usually predictable direction. The mist generators can be placed windward of the protected area, i.e., upwind, in the direction the wind and fire are expected to come from. When activated, the mist would be blown by the wind over the protected area and the approach to it, soaking it and raising the air humidity, thereby impeding a wildfire's progress.

Disclosed aspects do not rely upon fire-retardant chemicals other than water. However, the disclosed aspects are not limited to water.

In one aspect, a wide-area wildfire suppression system comprises a plurality of geographically distributed water sprayers; at least one wind sensor, which is configured to detect at least a wind direction; and a fire-suppression controller communicatively coupled to the water sprayers and the at least one wind sensor. The fire-suppression controller can comprise a computer processor that is responsive to at least the wind direction for activating at least one of the water sprayers.

The geographically distributed water sprayers may be placed to protect specific combustible assets in a geographical area, such as buildings, trees, plants, vehicles, pipelines, power lines, equipment, fences, etc. In some aspects, water sprayers may be placed on and/or outside a perimeter of an area to be protected. In other aspects, water sprayers may be distributed throughout an area to be protected.

Water sprayers, as disclosed herein, can include sprinklers, mist generators, and/or fog generators. Disclosed aspects can be configured to provide efficient provisioning of water resources for fighting wildfires by exploiting wind for distributing water mist to protect assets and/or suppress fires. Instead of just providing offsets to fire-suppressant jets to compensate for wind, disclosed methods and apparatus aspects can exploit wind direction and/or speed to improve the distribution of fire suppressants in order to protect combustible assets. For example, disclosed aspects can activate individual or groups of sprayers to protect downwind assets and/or actively suppress fires. Accordingly, disclosed aspects can be provisioned for either or both defensive and offensive fire-fighting operations.

In addition to exploiting winds to distribute fire suppressants, such as water, disclosed apparatus and method aspects can be configured to adapt water droplet size, spray patterns, flow rates, and/or spray directions based on a number of factors, including local conditions (e.g., wind direction, wind speed, temperature, smoke, proximity to fire), the types of assets to protect (e.g., combustibility, value, priority, size), the amount of available fire suppressant, regional conditions, and/or forecasted regional and local conditions.

In some aspects, a wide-area wildfire suppression system comprises a plurality of geographically distributed environment sensors. The sensors may be proximate to the geographically distributed water sprayers. The sensors can comprise wind sensors (which detect wind direction, and possibly wind speed), temperature sensors, humidity sensors, barometric pressure sensors, acoustic sensors, smoke sensors, flame sensors, and/or other types of sensors. Sensors may include cameras, such as high-definition video cameras, infrared cameras, and/or other cameras. Communication links can be provided via a communication network for communicating sensor data to a central processor, which may include a distributed computing system, a Cloud computing system, and/or other physical and/or virtual computing assets.

The wide-area wildfire suppression system may comprise a water distribution controller for a water distribution network that supplies water to the geographically distributed water sprayers, and the controller may activate valves (such as section valves) to turn on and/or shut off water to different parts of the water distribution network. The water distribution controller may be operable by the central processor.

Each of the water sprayers may have a sprayer head control system, which can adapt flow rate, droplet size, spray pattern, spray direction, aeration, and/or possibly other parameters to create fog, cool air temperature, coat combustible assets, and/or extinguish fires. The spray head control system might comprise valves, baffles, selectable spray heads, and the like to adjust the aforementioned parameters. Each spray head control system may be operable by the central processor and/or by a local processor.

In some aspects, the central processor is configured to perform sensor fusion of data from multiple sensors and compute a fire-suppression strategy based on local conditions indicative of each sensor reading. Furthermore, the central processor may collect data from external sources, such as weather stations, other wide-area wildfire suppression systems, satellite images, weather forecasting services, etc. The data from external sources may include user input data. The central processor can generate control messages based on the fire-suppression strategy to operate the water distribution network and/or the spray head control systems. Disclosed aspects can comprise methods for developing the fire-suppression strategy from the wind sensor data, and for controlling a network of sprayers in response to the fire-suppression strategy.

In one aspect, an apparatus that may be provisioned in a distributed fire-suppression network comprises a water sprayer; a wind sensor configured to detect at least a wind direction; and a fire-suppression controller (such as a computer processor) communicatively coupled to the water sprayer and the wind sensor. The fire-suppression controller can be configured to be responsive to at least the wind direction for activating the water sprayer. For example, when the fire-suppression controller senses a wind direction that is upwind of a combustible asset to be protected, the fire-suppression controller can activate the water sprayer. Similarly, the fire-suppression controller can deactivate the water sprayer upon a change in wind direction. In some aspects, the fire-suppression controller can activate and/or deactivate the water sprayer based on one or more of wind speed, wind direction, air temperature, smoke detection, flame detection, humidity, sound, and air pressure. For example, the fire-suppression controller can activate and/or deactivate the water sprayer when the wind speed exceeds a threshold value and/or drops below a threshold value. The fire-suppression controller might employ a combination of wind direction and wind speed measurements along with asset locations to activate and/or deactivate one or more water sprayers. The fire-suppression controller might select or adjust physical characteristics of the water spray (e.g., water droplet size, spray pattern, water flow rate, and/or spray direction) based on wind speed, wind direction, air temperature, smoke detection, flame detection, humidity, sound, and/or air pressure, for example. In some aspects, the apparatus might be communicatively coupled to other similar apparatuses, and might be configured to coordinate activating and/or controlling the water sprayer with the other apparatuses.

The foregoing has outlined rather broadly the features and technical advantages of examples according to the disclosure in order that the detailed description that follows may be better understood. Additional features and advantages will be described hereinafter. The conception and specific examples disclosed may be readily utilized as a basis for modifying or designing other structures for carrying out the same purposes of the present disclosure. Such equivalent constructions do not depart from the scope of the appended claims. Characteristics of the concepts disclosed herein, both their organization and method of operation, together with associated advantages will be better understood from the following description when considered in connection with the accompanying figures. Each of the figures is provided for the purpose of illustration and description only, and not as a definition of the limits of the claims.

BRIEF DESCRIPTION OF THE DRAWINGS

A further understanding of the nature and advantages of the present disclosure may be realized by reference to the following drawings. In the appended figures, similar components or features may have the same reference label. Flow charts depicting disclosed methods comprise "processing blocks", "elements", or "steps" that may represent computer software instructions or groups of instructions. Alternatively, the processing blocks or steps may represent steps performed by functionally equivalent circuits, such as a digital signal processor or an application specific integrated circuit (ASIC). It will be appreciated by those of ordinary skill in the art that unless otherwise indicated herein, the particular sequence of steps described is illustrative only and can be varied. Unless otherwise stated, the steps described below are unordered, meaning that the steps can be performed in any convenient or desirable order.

DETAILED DESCRIPTION

Various aspects of the disclosure are described below. It should be apparent that the teachings herein may be embodied in a wide variety of forms and that any specific structure, function, or both being disclosed herein are merely representative. Based on the teachings herein one skilled in the art should appreciate that an aspect disclosed herein may be implemented independently of any other aspects and that two or more of these aspects may be combined in various ways. For example, an apparatus may be implemented or a method may be practiced using any number of the aspects set forth herein. In addition, such an apparatus may be implemented or such a method may be practiced using other structure, functionality, or structure and functionality in addition to or other than one or more of the aspects set forth herein.

Figure 1:
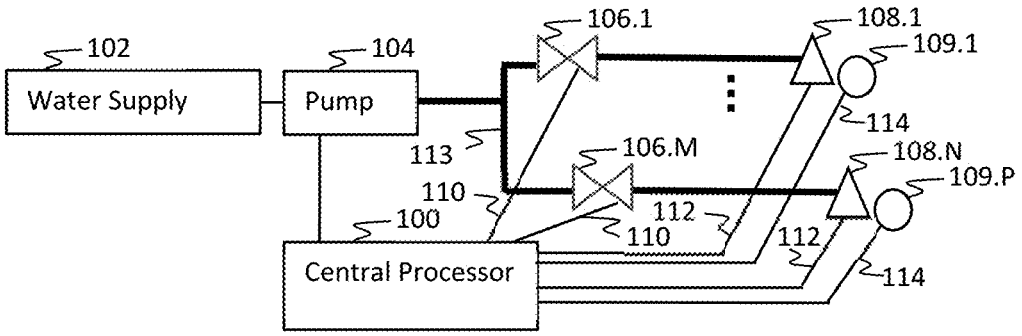
FIG. 1 depicts a distributed fire-suppression system which can be configured in accordance with aspects of the disclosure.

FIG. 1 is a diagram of a distributed fire-suppression system which can be configured in accordance with aspects of the disclosure. Geographically distributed spray heads 108.1-108.N are positioned to protect a wide geographical area from wildfires. A water distribution system comprising pipes or tubes 113, valves 106.1-106.M, at least one pump 104, and at least one water supply provides water to the spray heads 108.1-108.N. In some aspects, a distributed water source may be provided whereby each spray head or group of spray heads has its own water source. Such distributed water sources can include water tanks, reservoirs, springs, ponds, streams, rivers, lakes, seas, and/or other water sources. One or more wind sensors 109.1-109.P provide at least measurements of wind direction, and a central processor 100 receives the measurements via a sensor communication link, such as a wireless sensor network 114. The central processor 100 is configured to activate specific ones of the spray heads 108.1-108.N in response to at least the wind direction measurements, which can be accomplished by controlling section valves (e.g., valves 106.1-106.M) in the water distribution system and/or controlling the spray heads 108.1-108.N. In the case of a distributed water source, the central processor 100 may operate spray heads 108.1-108.N and/or valves 106.1-106.M in accordance with the amount of water available to each spray head (or group of spray heads) 108.1-108.N. A communication network 110 can communicatively couple the central processor 100 to the valves 106.1-106.M, and/or communication network 112 can communicatively couple the central processor 100 to the spray heads 108.1-108.N.

Figure 5A:
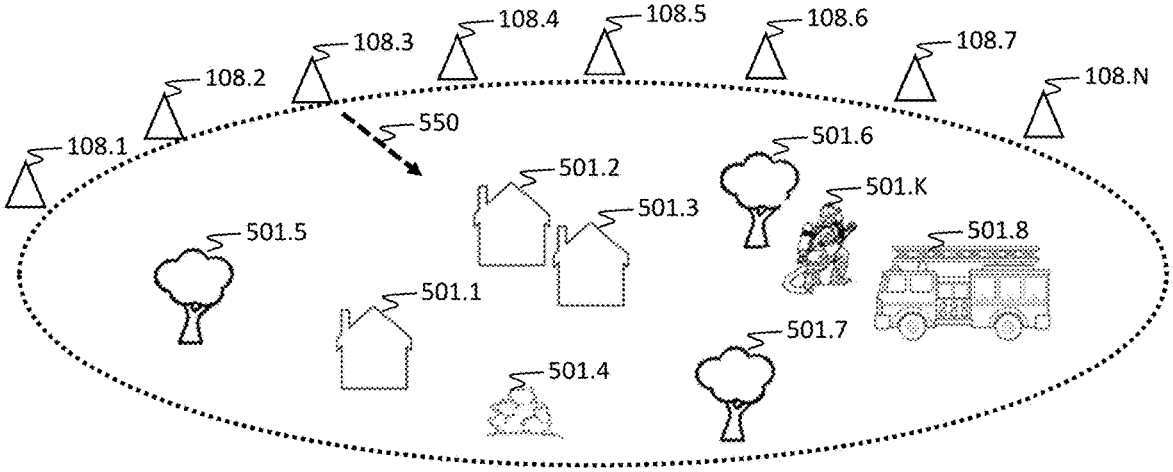
FIGS. 5A and 5B illustrate exemplary, but non-limiting, geographical distributions of spray heads in a distributed fire-suppression system accordance with some disclosed aspects.
Figure 5B:
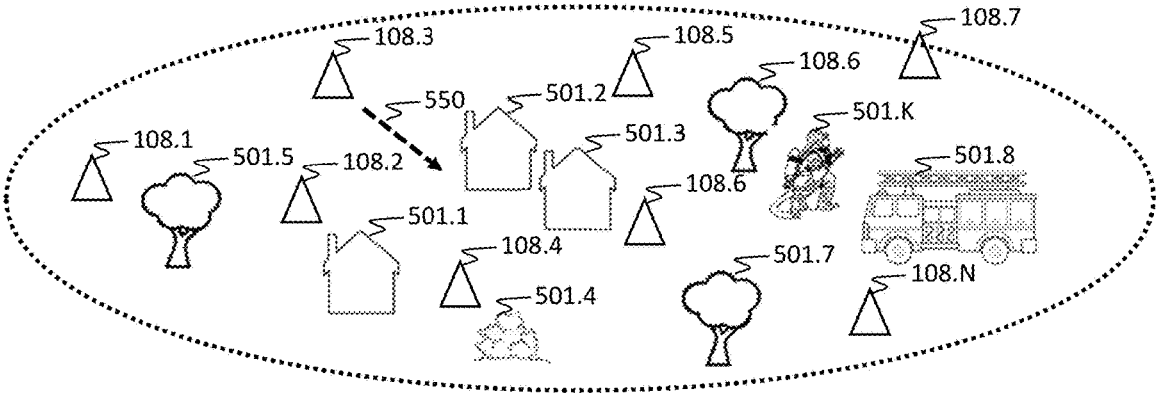

FIGS. 5A and 5B illustrate exemplary, but non-limiting, geographical distributions of the spray heads 108.1-108.N in accordance with some disclosed aspects. In FIG. 5A, the spray heads 108.1-108.N are located along a perimeter of an area that comprises assets 501.1-501.K to be protected. The assets 501.1-501.K can comprise any combination of fixed and mobile assets. A measured wind direction is indicated by vector 550. In FIG. 5B, the spray heads 108.1-108.N are distributed throughout the area that comprises the assets 501.1-501.K. The spray heads 108.1-108.N may be distributed uniformly or proximate to particular assets 501.1-501.K, for example. In disclosed aspects, particular spray heads 108.1-108.N can be activated in response to the measured wind direction 550 and the relative locations of assets 501.1-501.K (and/or fire) from each spray head. Spray heads 108.1-108.N that are upwind of particular assets 501.1-501.K (and/or fire) can be activated to protect the assets 501.1-501.K and/or extinguish the fire.

The spray heads 108.1-108.N can comprise sprinklers, mist sprayers, fog generators, atomizers, microatomizers, and the like, for example. In one aspect, fog jet nozzles atomize water under high pressure. A small-orifice misting nozzle forces fluid through a very small orifice at high pressure, generating sufficient turbulence to atomize the spray into a fine fog. In a misting impingement nozzle, the fluid is ejected from the nozzle orifice and impacts upon a pin in the direct path of the water flow, which breaks up and disrupts the flow into a fine spray. Spiral nozzles produce a relatively fine spray with low to medium droplet sizes. For example, a spiral nozzle will have a full cone pattern that, for a given pressure, flow rate and spray angle, produces smaller droplets than an axial whirl nozzle. Air atomizing nozzles produce very fine droplets, and the reach of these fine sprays can be enhanced with pressurized air. For air atomizing nozzles, the level of atomization is primarily a function of the amount of air being used. The higher the air pressure and flow rate, the smaller the droplets are. This means that even very low flow rates at low fluid pressures can be finely atomized.

In some aspects, the spray heads 108.1-108.N can be adjustable or selectable to produce different droplet sizes. By way of example, a spray nozzle might have a round or oval inlet opening, after which the fluid is pushed out through an outlet that is either wedge shaped or circular such that a sheet is formed that subsequently breaks up to form a spray. The pressure can be controlled to adjust droplet size, wherein higher pressure is used to shift the droplet-size distribution to smaller droplets. Also, for any given flow rate, a wider spray angle typically provides for smaller droplet sizes. Small droplets decelerate quicker than large droplets and fall through the air slowly, making them more likely to be carried farther by wind. As a general rule, the smaller the droplet size, the greater the cooling effect. This is because as the diameter of droplets decreases, the overall surface area of the spray increases, meaning that evaporation/vaporization occurs faster. This provides a more efficient use of potentially scarce water resources for fighting wildfires. But sprays with smaller droplets have lower momentum, so they are more easily disrupted by air currents or winds, which is a significant problem given that wildfires cause strong thermal air currents. Thus, disclosed aspects employ a distributed network of spray heads with local and/or centralized control mechanisms configured to exploit wind and thermal air currents to provide fire protection and fire-fighting capability over a wide geographical area.

In some aspects, spray heads 108.1-108.N can include electronically controlled nozzles, such as with adjustable baffles to adjust droplet size, spray pattern, and/or flow rate. The nozzle inlet and/or outlet may be adjustable. It should be appreciated that other nozzle types and alternative techniques for adjusting the physical parameters of the spray produced by a nozzle may be provided in the disclosed aspects. In some aspects, the specific gravity or viscosity of the fluid may be selected, such as to select the flow rate and/or droplet size.

In some aspects, the spray heads 108.1-108.N are electronically controlled by the central processor 100 via the communication network 112, such as to activate specific ones or groups of the spray heads 108.1-108.N in response to one or more fire-fighting strategies that may be generated from sensor measurements, user inputs, asset locations, asset types, and/or external data sources. The spray heads 108.1-108.N may be electronically controlled by the central processor 100 to select physical parameters of the spray, such as droplet size, spray pattern, flow rate, spray direction, and/or spray elevation. In some aspects, the valves 106.1-106.M are electronically controlled by the central processor 100 via the communication network 110, such as to adjust the flow and/or pressure of water delivered to the spray heads 108.1-108.N, and/or to shut off the flow to pipes where leaks are detected. The valves 106.1-106.M may be controlled in response to sensor readings, such as pressure and flow rate in the water distribution system, and/or the amount of water available from each water source if a distributed water source is employed. In some aspects, the central processor 100 receives sensor data from a distributed sensor network that comprises the wind sensors 109.1-109.P. Any of the communication networks 110, 112, and 114 can comprise a wireless network. Wireless networks mentioned herein can include cellular networks (e.g., 4G, 5G networks), wide area wireless networks, wireless sensor networks, Internet-of-Things (IoT) networks, airborne networks, mesh networks, vehicular ad-hoc networks, and or any other network that employs wireless technology.

The combination of sensors 109.1-109.P and communication links 114 may be a wireless sensor network. The network 114 may comprise various network apparatuses, such as routers, relays, repeaters, gateways, switches, data aggregation points (DAPS), and/or other network devices. The sensors 109.1-109.P can be distributed throughout the geographical area to be protected. In some aspects, each sensor can be proximate to a particular spray head, a group of spray heads 108.1-108.N, or an asset. Sensors may comprise fixed or mobile sensors. Sensor measurements received by the central processor may be used to develop a fire-fighting strategy (and corresponding control messages generated therefrom) to activate one or more of the spray heads 108.1-108.N near where the sensor measurements were made. Some amount of edge computing may be performed proximate to the sensors 109.1-109.P, such as to preprocess sensor data before it is communicated to the central processor 100. In addition to wind direction sensors, the sensors 109.1-109.P may comprise wind speed sensors, air temperature sensors, smoke detection sensors, flame detection sensors, humidity sensors, acoustic sensors, spectrometers, and/or air pressure sensors. Furthermore, sensors 109.1-109.P may comprise any of various types of cameras, including video cameras, infrared cameras, and/or still-image cameras.

Figure 2:
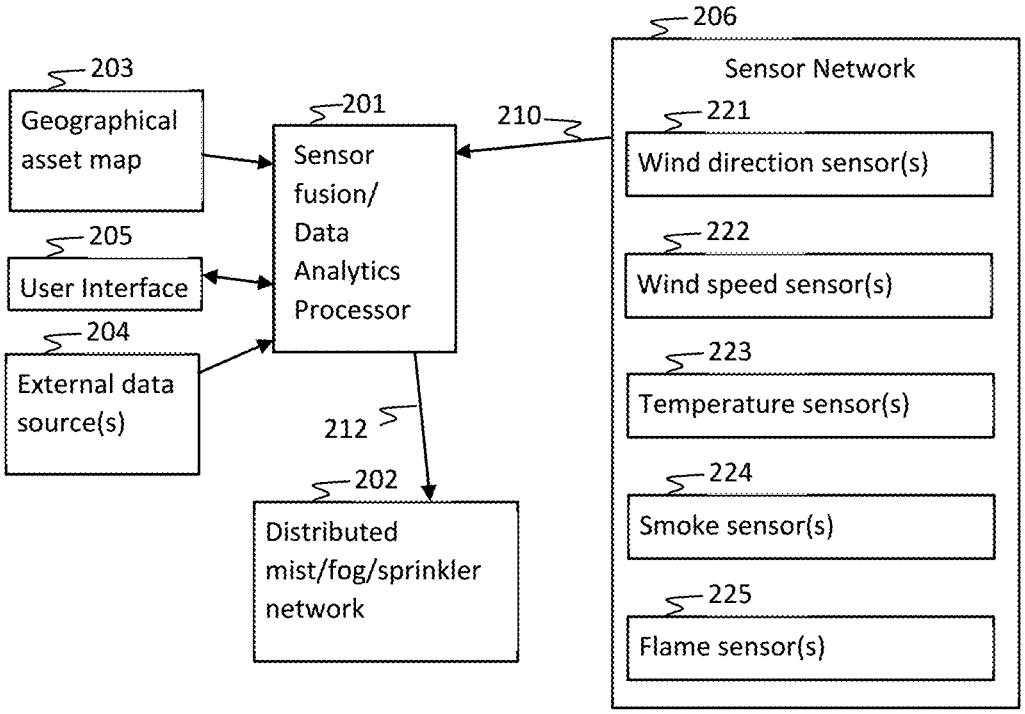
FIG. 2 illustrates functional aspects that can be performed by a computer processor, such as a central processor, according to aspects disclosed herein.

FIG. 2 illustrates functional aspects that can be performed by a central processor 100. For example, a sensor fusion/data analytics processor 201 can be a functional aspect of the central processor 100, and may be performed by one or more CPUs, such as in a distributed-computing or Cloud-computing configuration, and might comprise one or more virtualized hardware components, including processors, memory, routers, and the like. It should be appreciated that the processor 201 may employ machine learning, such as artificial neural networks (including deep learning neural networks) to perform any of the function disclosed herein.

The processor 201 receives sensor data from a sensor network 206 that includes at least wind direction sensors 221, and may further include any of a set of sensors that includes wind speed sensors 222, temperature sensors 223, smoke sensors 224, flame sensors 225, and/or other sensors (not shown). A communication link or network 210 delivers sensor data to the processor 201. Location information for each sensor may be provided to the processor 201. In one aspect, the location of each sensor may be recorded in a database stored in a memory that the processor 201 can access. In another aspect, each sensor's location may be determined by the network 210, such as via location computations based on received signal strength, triangulation, or other techniques utilizing network 210 transceivers. In some aspects, each sensor includes a navigation or positioning (e.g., a GPS) receiver and reports its location via the network 210 to the processor 201. Data from one or more external data sources 204 may be input to the processor 201. Such external data sources 204 may include weather reports, weather forecasts, satellite images, data from other sensor networks, fire data, news services, and other information sources. The processor 201 can be communicatively coupled to external data sources 204 via a wireless network, a cellular network, the Internet, or some other network.

The processor 201 can employ a geographical asset map 203, with reference to the geographical locations of the spray heads 108.1-108.N widely distributed in a fire-suppression network (e.g., distributed mist/fog/sprinkler network) 202, to develop a fire suppression strategy in response to at least wind direction sensor 221 data. In some aspects, the geographical asset map 203 may comprise a geographic information system (GIS) that can be provisioned to capture, analyze, manage, and/or display any of various forms of geographically referenced information. A GIS can provide information to the processor 201 that is useful for analyzing fire conditions and/or weather, provisioning firefighting assets and supplies, and scheduling firefighting resources. The geographical asset map 203 may be updated as the locations of mobile assets change. Thus, the asset map 203 may comprise a GPS receiver configured to collect position and movement data from mobile assets. In some aspects, the asset map may be updated to indicate new priorities for selected ones of the assets. An asset's priority might be based on various factors, such as its proximity to fire. The processor 201 may employ the asset map 203 and the sensor network 206 data to determine which assets to protect, how to provision fire-fighting resources, and which spray heads 108.1-108.N in the fire-suppression network 202 to activate. The processor 201 may process the sensor network 206 data (and possibly any of its other inputs) to select physical characteristics of the water spray (e.g., water droplet size, spray pattern, water flow rate, spray elevation, and/or spray direction).

The processor 201 may comprise a user interface 205, which may display asset maps 203, sensor network 206 data (including camera feeds), operating conditions of the fire-suppression network 202, and/or external data 204. The user interface 205 may be configured to enable a user to enter data and/or commands into the processor 201. In some aspects, the user interface 205 can be configured to control operations of the fire-suppression network 202 via the processor 201, set or update sensor value thresholds that the processor 201 uses to control operation of the fire-suppression network 202, reconfigure operating parameters or software used by the processor 201 to evaluate data inputs and/or determine control functions, update the asset map 203, and/or update the external data source(s) 204 made available to the processor 201. In some aspects, the user interface 205 may be used to run diagnostic tests, perform maintenance checks, verify proper system functions, and/or troubleshoot problems in the processor 201, fire-suppression network 202, sensor network 206, external data sources 204, and/or associated communication networks (e.g., 210 and 212). In some aspects, the user interface 205 may be configured to operate on a server or desktop computer, such as may be located in a command center, and/or the user interface 205 may be configured to operate on a mobile device, such as a smartphone, a tablet, a wearable device, or some other user equipment.

Since wind can shift the apparent source of a fire from its actual source, the distributed sensor network 206 can provide data for the processor 201 to enable real-time situational awareness of fire conditions, predict how the fire will spread, and respond with a fire-protection/fire-suppressant strategy that protects assets that are most at risk. Temperature, humidity, wind speed, and wind direction can all vary greatly across complex terrain. Furthermore, firestorms can generate their own winds from a convective updraft of heat, which draws in air from all sides and fans flames. Rotating winds can develop along the edge of a fire. These vortices are a result of the contrast between the hot air associated with the fire edge and the cooler air over the adjacent, non-burning region. The substantial influence that the fire has on the winds surrounding it makes the precise direction and speed of the spread of the fire difficult to forecast. However, the distributed sensor network 206 in combination with the distributed fire-suppression network 202 can provide the processor 201 with the necessary information and capabilities to effectively respond to conditions at both a fine granularity (e.g., local level) and a coarse granularity (e.g., wide area, or regional level). Furthermore, effective responsiveness to each set of local conditions enables an efficient provisioning of resources to protect assets and fight wildfires over a wide area.

GIS data can be useful in combination with the sensor network 206 measurements for wide area fire protection/suppression planning. For example, airflows over mountainous or hilly landscapes can be channeled by the topography in a number of different ways: downward momentum transport; forced channeling; and pressure-driven channeling. Downward momentum transport happens when airflows in the upper atmosphere are mixed down to the surface by a large fire. Because the momentum of the upper winds must be conserved, the surface winds take on some of the direction of the winds aloft; the momentum of the upper winds is transported downwards. Forced channeling results when the sidewalls of a valley cause mechanical deflection of an airflow. Under certain conditions, the winds within a valley can undergo an immediate reversal as the direction of the airflow changes across a line perpendicular to the valley axis. Pressure-driven channeling can cause valley winds when a synoptic pressure gradient is superimposed on a valley. This can cause valley winds that flow in a direction opposite to the along-valley component of the prevailing winds. The processor 201 can employ GIS data, sensor measurements, and possibly external data to predict fire-generated winds, display those predictions, and compute fire protection/suppression strategies for wide-area asset protection.

Figure 3:
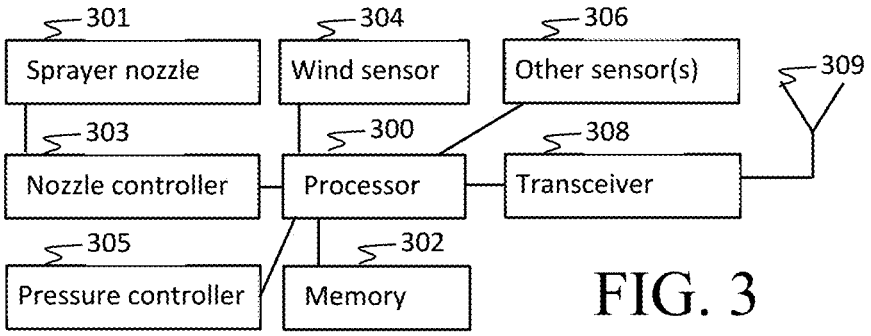
FIG. 3 is a block diagram of an apparatus in accordance with some aspects of the disclosure.

FIG. 3 is a block diagram of an apparatus in accordance with some aspects of the disclosure. A sprayer head can comprise a sprayer nozzle 301, a nozzle controller 303, and possibly a water-pressure controller 305. A computer processor 300 can be communicatively coupled to the nozzle controller 303 to control how the sprayer nozzle 301 functions. The processor 300 can be communicatively coupled to the pressure controller 305 to adjust water pressure at the sprayer nozzle 301. A memory 302 can be provided for storing computer programs (e.g., software) executable by the processor 301. The memory 302 may also store data, including sensor data. The processor 300 can be communicatively coupled to at least a wind sensor 304 and may be coupled to at least one other type of sensor 306. A transceiver 308 may be provided for communicating data, software, and/or commands between the processor 300 and at least one other processor (not shown) or user interface (not shown). The transceiver 308 may comprise a radio, in which case it would include an antenna system 309 comprising one or more antennas. Any of the elements shown in FIG. 3, such as the nozzle 301 and sensors 304 and 306, can be hardened against fire or heat damage.

The sprayer nozzle 301 may comprise multiple selectable nozzles or sprayer heads, valves, baffles, and/or other mechanical components that can adjust the flow of water and/or air to change physical parameters of the spray. The nozzle controller 303 can comprise electronic control of the aforementioned mechanical components, and may comprise at least part of a sprayer head control system configured to adapt flow rate, droplet size, spray pattern, spray direction, aeration, and/or possibly other parameters to create fog, mist, and/or other types of water sprays. The pressure controller 305 can comprise an electronic control that enables the processor 300 to control water pressure and/or air pressure to the nozzle 301.

The wind sensor 304 and possibly at least one other sensor 306 is communicatively coupled to the processor 300. In one aspect, the sensor 304 (and possibly sensor(s) 306) are part of the apparatus that comprises the nozzle 301. In another aspect, the sensor 304 (and possibly sensor(s) 306) are separate devices comprising their own transceivers which can be communicatively coupled to the processor via the transceiver 308. In one aspect, each sensor (304, 306) comprises a navigation or positioning (e.g., GPS) receiver used for determining location, and the sensor (304, 306) communicates its location to the processor 300 via a wireless sensor network. In another aspect, the processor 300 determines the sensor's (304, 306) location relative to the nozzle 301 and/or assets from measurements of sensor (304, 306) transmissions in the wireless sensor network. The sensors (304, 306) may be fixed or mobile sensors. In some aspects, the sensors (304, 306) can be dropped from an aircraft or by personnel on the ground to be distributed over a wide area.

The processor 300 comprises one or more computing devices. In some aspects, the processor 300 resides in the apparatus. In another aspect, at least one processing element of the processor 300 is physically separate from the apparatus, but is communicatively coupled to the controller 303 and/or 305 via a wireless network. The processor 300 may reside nearby the nozzle 301 and/or sensors (304, 306). In some aspects, the processor 300 comprises at least one computing element in a sensor (304, 306), and is configured to control the operation of one or more nearby nozzles 301. In some aspects, the processor 300 comprises multiple edge-computing elements residing in multiple sensors and/or spray heads. The processor 300 may use the transceiver 308 to communicate with processors in other spray heads, such as to share sensor data, operational statuses, commands, and other information. The processor 300 may use the transceiver 308 to communicate the aforementioned information to a central processor, such as may reside in a data center or in an operations or command center. In some aspects, the processor 300 employs the transceiver 308 to communicate any of the aforementioned information to mobile computing devices, such as communication devices that might be used by firefighters and other first responders.

FIGS. 4A, 4B, 4C, and 4D are flow diagrams that depict methods and functional structures that can be employed in aspect of the disclosure. For example, such methods may be implemented by an electronic circuit, such as a special-purpose processor. Any of the disclosed methods may be performed by a general purpose processor programmed with computer software. Functional elements or steps disclosed herein can comprise software code stored on a non-transitory computer-readable memory, which, when read by a processor, implement the disclosed methods. Various elements or steps can be implemented using machine-learning algorithms and may employ any of various computing structures, such as deep-learning neural networks, convolutional neural networks, recurrent neural networks, long short term memory (LSTM) networks, as well as others.

Figure 4A:
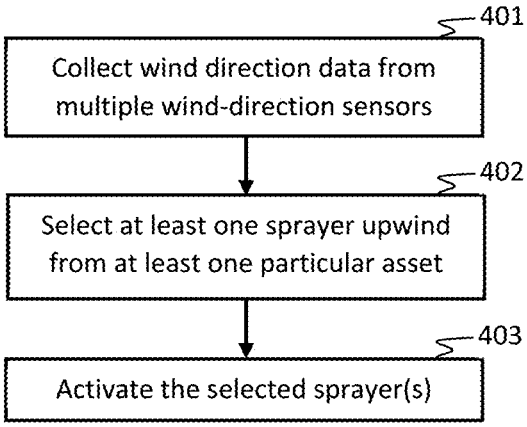
FIGS. 4A, 4B, 4C, and 4D are flow diagrams that depict methods and functional structures that can be employed in aspect of the disclosure.

FIG. 4A depicts a flow diagram in which wind-direction data is collected 401 from multiple wind-direction sensors that can be distributed throughout a wide geographical area. At least one sprayer in a distributed fire-suppression network is selected 402 upwind of an asset to be protected or a fire to be suppressed, and the sprayer(s) is (are) activated 403. In some aspects, this method can be performed locally by a processor at or near each sprayer. In some aspects, data collected from the wind-direction sensors might be processed separately or in aggregate at a central processor, which selects particular ones of the sprayers to activate. Any combination of edge computing and centralized computing may be performed.

Figure 4C:
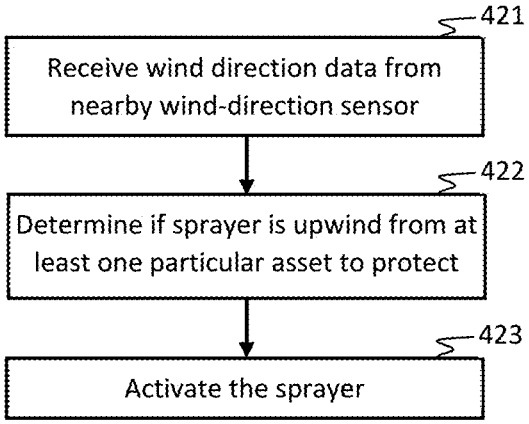
Figure 4B:
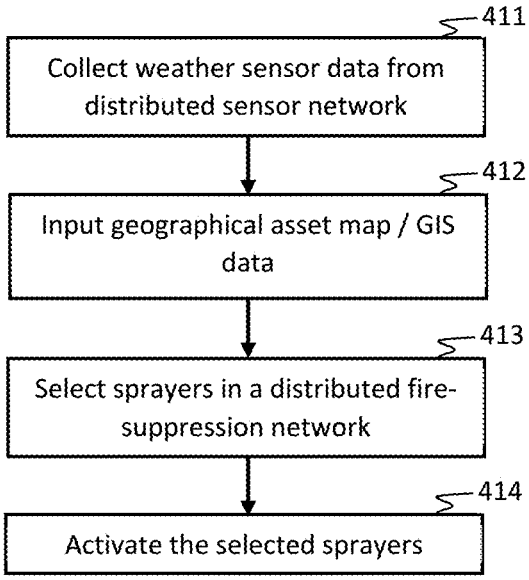

FIG. 4B depicts a flow diagram in which wind-direction data is collected 411 from multiple wind-direction sensors distributed throughout a wide geographical area, and GIS data including a geographical asset map is input 412. The wind-direction and GIS data are processed to select 413 sprayers in a distributed fire-suppression network that are upwind of one or more assets to be protected, or upwind of a fire to be suppressed. Any combination of edge computing and centralized computing may be performed to select 413 the sprayers. Then the selected sprayers are activated 414.

FIG. 4C depicts a flow diagram in which wind-direction data is collected 421 from a sensor, and a determination is made 422 to select at least one sprayer near the sensor that is upwind from an asset to be protected or a fire to be extinguished. Then the selected sprayer(s) is (are) activated 423. This method may be performed by a processor located at a sensor or a sprayer, for example.

Figure 4D:
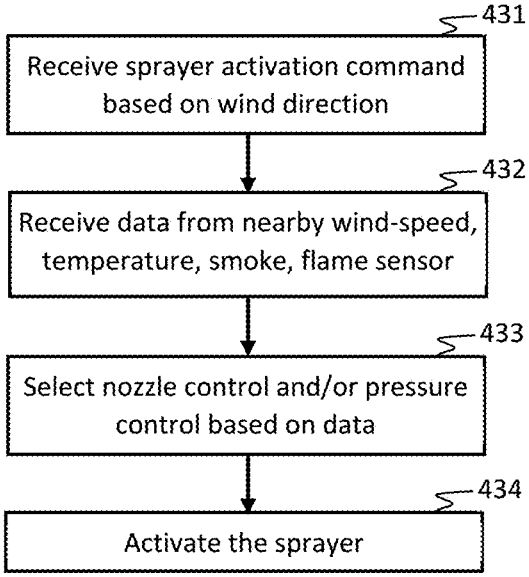

FIG. 4D depicts a flow diagram in which a sprayer receives 431 an activation command based on wind direction, wherein the sprayer is upwind of at least one asset to be protected or at least one fire to be extinguished. A processor that is near the sprayer or a wind sensor (including a processor that is physically coupled to the sprayer or wind sensor) may be configured to control the operation of the sprayer in response to the activation command such as may be received from another processor, such as a central controller. The processor also receives 432 data from one or more nearby sensors, which can include any combination of wind speed, temperature, smoke detection, flame detection, humidity, acoustic, and barometric pressure sensors. The processor uses this data to select 433 nozzle control and/or pressure control settings to produce a flow rate, droplet size, spray pattern, spray direction, aeration, and/or possibly other parameters to create fog, cool air temperature, coat combustible assets, and/or extinguish fires. The processor then activates 434 the sprayer.

The description set forth herein, in connection with the appended drawings, describes example configurations and does not represent all the examples that may be implemented or that are within the scope of the claims. The term "exemplary" used herein means "serving as an example, instance, or illustration," and not "preferred" or "advantageous over other examples." The detailed description includes specific details for the purpose of providing an understanding of the described techniques. These techniques, however, may be practiced without these specific details. In some instances, well-known structures and devices are shown in block diagram form in order to avoid obscuring the concepts of the described examples.

In the appended figures, similar components or features may have the same reference label. Further, various components of the same type may be distinguished by following the reference label by a dash and a second label that distinguishes among the similar components. If just the first reference label is used in the specification, the description is applicable to any one of the similar components having the same first reference label irrespective of the second reference label.

Information and signals described herein may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

The various illustrative blocks and modules described in connection with the disclosure herein may be implemented or performed with a general-purpose processor, a digital signal processor (DSP), an ASIC, a field-programmable gate array (FPGA) or other programmable logic device, discrete gate or transistor logic, discrete hardware components, or any combination thereof designed to perform the functions described herein. A general-purpose processor may be a microprocessor, but in the alternative, the processor may be any conventional processor, controller, microcontroller, or state machine. A processor may also be implemented as a combination of computing devices (e.g., a combination of a DSP and a microprocessor, multiple microprocessors, one or more microprocessors in conjunction with a DSP core, or any other such configuration).

The functions described herein may be implemented in hardware, software executed by a processor, firmware, or any combination thereof. If implemented in software executed by a processor, the functions may be stored on or transmitted over as one or more instructions or code on a computer-readable medium. Other examples and implementations are within the scope of the disclosure and appended claims. Features implementing functions may also be physically located at various positions, including being distributed such that portions of functions are implemented at different physical locations. Also, as used herein, including in the claims, "or" as used in a list of items (for example, a list of items prefaced by a phrase such as "at least one of" or "one or more of") indicates an inclusive list such that, for example, a list of at least one of A, B, or C means A or B or C or AB or AC or BC or ABC (i.e., A and B and C).

Computer-readable media includes both non-transitory computer storage media and communication media including any medium that facilitates transfer of a computer program from one place to another. A non-transitory storage medium may be any available medium that can be accessed by a general purpose or special purpose computer. By way of example, and not limitation, non-transitory computer-readable media may comprise RAM, ROM, electrically erasable programmable read only memory (EEPROM), compact disk (CD) ROM or other optical disk storage, magnetic disk storage or other magnetic storage devices, flash memory, or any other non-transitory medium that can be used to carry or store desired program code means in the form of instructions or data structures and that can be accessed by a general-purpose or special-purpose computer, or a general-purpose or special-purpose processor. Also, any connection is properly termed a computer-readable medium. For example, if the software is transmitted from a website, server, or other remote source using a coaxial cable, fiber optic cable, twisted pair, digital subscriber line (DSL), or wireless technologies such as infrared, radio, and microwave, then the coaxial cable, fiber optic cable, twisted pair, digital subscriber line (DSL), or wireless technologies such as infrared, radio, and microwave are included in the definition of medium. Disk and disc, as used herein, include CD, laser disc, optical disc, digital versatile disc (DVD), floppy disk and Blu-ray disc where disks usually reproduce data magnetically, while discs reproduce data optically with lasers. Combinations of the above are also included within the scope of computer-readable media.

The description herein is provided to enable a person skilled in the art to make or use the disclosed aspects. Various modifications to the disclosed aspects will be readily apparent to those skilled in the art, and the generic principles defined herein may be applied to other variations without departing from the scope of the disclosure. Thus, the disclosure is not limited to the examples and designs described herein, but is to be accorded the broadest scope consistent with the principles and novel features disclosed herein.

The invention claimed is:

1. An apparatus for wide-area wildfire suppression, comprising:

at least one wind sensor;

at least one processor in electronic communication with the at least one wind sensor; and at least one memory in electronic communication with the at least one processor, and instructions stored in the at least one memory, the at least one processor executing the instructions, the instructions comprising:

the at least one processor determining wind speed and wind direction from sensor data received from the at least one wind sensor;

the at least one processor using the wind speed, the wind direction, a geographical location of each of a plurality of geographically distributed water sprayers, and a geographical location of at least one asset to be protected to select particular ones of the plurality of geographically distributed water sprayers that are upwind from the at least one asset to be protected; and the processor selecting, based on at least one of the wind speed, geographical location of each of the particular ones of the plurality of geographically distributed water sprayers, and the geographical location of the at least one asset to be protected, a droplet size of water enabling the droplets to be carried farther by wind, sprayed by each of the particular ones of the plurality of geographically distributed water sprayers; the processor controlling the particular ones of the plurality of geographically distributed water sprayers to spray droplets of the droplet size enabling the droplets to be carried farther by wind.

2. The apparatus of claim 1, further comprising instructions executable by the at least one processor for configuring each of the plurality of geographically distributed water sprayers to adjust at least one physical parameter of a water spray, the at least one physical parameter comprising flow rate, spray pattern, spray direction, spray elevation, or aeration.

3. The apparatus of claim 1, further comprising instructions executable by the at least one processor for collecting at least one of temperature, smoke, flames, humidity, sound, and barometric pressure data, and employing the data for selecting the at least one of the plurality of geographically distributed water sprayers.

4. The apparatus of claim 1, wherein the plurality of geographically distributed water sprayers is located along a perimeter of the area to be protected, located throughout the area to be protected, or proximate to the at least one asset.

5. The apparatus of claim 1, further comprising instructions executable by the at least one processor for deactivating one or more of the plurality of geographically distributed water sprayers in response to a change in wind direction.

6. The apparatus of claim 1, further comprising instructions executable by the at least one processor for adjusting at least one of flow rate, droplet size, aeration, spray pattern, spray direction, or spray elevation in response to at least one of temperature, smoke, flames, barometric pressure, sound, or humidity.

7. The apparatus of claim 1, wherein using the wind direction to select particular ones of the plurality of geographically distributed water sprayers employs at least one of an asset map and geographic information system data.

8. The apparatus of claim 1, further comprising instructions executable by the at least one processor for performing data analytics on the sensor data from the at least one wind sensor and at least one of wind speed sensors, temperature sensors, smoke sensors, or flame sensors to determine at least one of fire location and direction of fire movement.

9. The apparatus of claim 1, further comprising instructions executable by the at least one processor for updating an asset map based on location data for each mobile asset of the at least one asset.

10. The apparatus of claim 1, further comprising instructions executable by the at least one processor for at least one of activating a communications transceiver for receiving the sensor data from the at least one wind sensor, and transmitting control commands to at least one of the plurality of geographically distributed water sprayers.

11. A computer program product, comprising a non-transitory computer-readable storage device having computer-readable program code stored therein, the computer-readable program code containing instructions executable by at least one processor of a computer system, the at least one processor executing the instructions, the instructions comprising:

the processor determining, by the at least one processor, wind speed and wind direction from sensor data collected from at least one wind sensor;

the processor using the wind speed, the wind direction, a geographical location of each of a plurality of geographically distributed water sprayers, and a geographical location of at least one asset to be protected to select particular ones of the plurality of geographically distributed water sprayers that are upwind from the at least one asset or area to be protected; and selecting, by the at least one processor, based on at least one of the wind speed, geographical location of each of the particular ones of the plurality of geographically distributed water sprayers, and the geographical location of the at least one asset to be protected and the wind direction, droplet size of water enabling the droplets to be carried farther by wind, sprayed by each of the selection of particular ones of the plurality of geographically distributed water sprayers; the processor controlling the particular ones of the plurality of geographically distributed water sprayers to spray droplets of the droplet size enabling the droplets to be carried farther by wind to the at least one asset or area to be protected.

12. The computer program product of claim 11, further comprising instructions executable by the at least one processor for configuring each of the plurality of geographically distributed water sprayers to adjust at least one physical parameter of a water spray, the at least one physical parameter comprising flow rate, spray pattern, spray direction, spray elevation, or aeration.

13. The computer program product of claim 11, further comprising instructions executable by the at least one processor for collecting at least one of temperature, smoke, flames, humidity, sound, and barometric pressure data, and employing the data for selecting the at least one of the plurality of geographically distributed water sprayers.

14. The computer program product of claim 11, wherein the plurality of geographically distributed water sprayers is located along a perimeter of the area to be protected, located throughout the area to be protected, or proximate to the at least one asset.

15. The computer program product of claim 11, further comprising instructions executable by the at least one processor for deactivating one or more of the plurality of geographically distributed water sprayers in response to a change in wind direction.

16. The computer program product of claim 11, further comprising instructions executable by the at least one processor for adjusting at least one of flow rate, droplet size, aeration, spray pattern, spray direction, or spray elevation in response to at least one of temperature, smoke, flames, barometric pressure, sound, or humidity.

17. The computer program product of claim 11, wherein using the wind direction to select particular ones of the plurality of geographically distributed water sprayers employs at least one of an asset map and geographic information system data.

18. The computer program product of claim 11, further comprising instructions executable by the at least one processor for performing data analytics on sensor data from the at least one wind sensor and at least one of temperature sensors, smoke sensors, or flame sensors to determine at least one of fire location and direction of fire movement.

19. The computer program product of claim 11, further comprising instructions executable by the at least one processor for updating an asset map based on location data for each mobile asset of the at least one asset.

20. The computer program product of claim 11, further comprising instructions executable by the at least one processor for at least one of activating a communications transceiver for receiving the sensor data from the at least one wind sensor, and transmitting control commands to at least one of the plurality of geographically distributed water sprayers.

* * * * *